US011798769B1

(12) United States Patent
Berry et al.

(10) Patent No.: US 11,798,769 B1
(45) Date of Patent: Oct. 24, 2023

(54) CATHODE-IN-CATHODE HIGH-POWER MICROWAVE (HPM) VACUUM TUBE SOURCE AND METHOD OF ALIGNMENT

(71) Applicant: Raytheon Company, Waltham, MA (US)

(72) Inventors: Eric Alan Berry, Marana, AZ (US); David R. Sar, Marana, AZ (US); Sandra Stein, Marana, AZ (US); Alexander T. Burke, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 18/121,937

(22) Filed: Mar. 15, 2023

(51) Int. Cl.
*H01J 1/20* (2006.01)
*H01J 9/02* (2006.01)
*H01J 1/304* (2006.01)

(52) U.S. Cl.
CPC ..... *H01J 9/025* (2013.01); *H01J 1/20* (2013.01); *H01J 1/304* (2013.01)

(58) Field of Classification Search
CPC ..... H01J 1/20; H01J 1/304; H01J 9/025
USPC ..... 445/24
See application file for complete search history.

(56) References Cited

U.S. PATENT DOCUMENTS 4,912,366 A * 3/1990 Dionne ..... H01J 25/38 315/5.31
9,819,320 B1 11/2017 Hoff et al.
2022/0001451 A1* 1/2022 Kovalchuk ..... B22F 10/85

OTHER PUBLICATIONS

Emma, P., et al., "Beam-based alignment for the LCLS FEL undulator", Nuclear Instruments and Methods in Physics Research Section A: Accelerators, Spectrometers, Detectors and Associated Equipment, vol. 429, Issues 1-3, (Jun. 1999), 407-413.
Korovin, Sergei D., et al., "Pulsewidth Limitation in the Relativistic Backward Wave Oscillator", IEEE Transactions on Plasma Science, vol. 28, No. 3, (Jun. 2000), 485-495.
Zeng, Li, et al., "The beam-based alignment for soft X-ray free-electron lasers via genetic algorithm", Nuclear Instruments and Methods in Physics Research Section A: Accelerators, Spectrometers, Detectors and Associated Equipment, vol. 905, (Oct. 2018), 104-111.

* cited by examiner

*Primary Examiner* — Christopher M Raabe
(74) *Attorney, Agent, or Firm* — Schwegman Lundberg & Woessner, P.A.

(57) ABSTRACT

A high-power microwave (HPM) vacuum tube source and method of precise coaxial alignment of the field emission (FE) cathode, cylindrical RF generating tube and magnet field includes positioning a low-power thermionic emission (TE) cathode inside the FE cathode in a "cathode-in-cathode" arrangement. With the HPM source under vacuum and the FE cathode deactivated, the TE cathode emits a surrogate electron beam through the generating tube. Measurement circuits measure the surrogate electron beam's position with respect to a longitudinal axis fore and aft of the generating tube. The measurements circuits may, for example, be a repositionable fluorescent target or electric field sensors embedded in the cylindrical RF generating tube. The coaxial alignment of the primary cathode, cylindrical RE generating tube and magnet is adjusted until the position of the surrogate electron beam satisfies a coaxial alignment tolerance.

20 Claims, 12 Drawing Sheets

CATHODE-IN-CATHODE HIGH-POWER MICROWAVE (HPM) VACUUM TUBE SOURCE AND METHOD OF ALIGNMENT

FIELD

This disclosure relates to high-power microwave (HPM) vacuum tube sources and more particularly to a cathode-in-cathode structure and method for precise coaxial alignment of the Field Emission (FE) cathode, cylindrical RF generating tube and magnetic field.

DESCRIPTION OF THE RELATED ART

HPM vacuum tube sources may be configured either as an oscillator or amplifier to output high-power RF pulses. Such sources include within a vacuum chamber a Field Emission (FE) cathode that is configured to emit a pulsed electron beam and a cylindrical RF generating tube such as a slow wave structure (SWS) or resonant cavity that interacts with the pulsed electron beam to generate the RF pulses. A magnet such as an electro-magnet (EM) is configured to produce a magnetic field in the vacuum chamber having field lines parallel to the longitudinal axis of the tube to constrain the electron beam and accelerate the electrons to sufficiently high velocities to interact with the generating tube. To ensure proper operation and to avoid damaging the RF generating tube it is critical that the FE cathode, RF generating tube and magnetic field are coaxially aligned to a tight tolerance.

Referring now to FIG. 1, a known configuration of an HPM vacuum tube source 100 includes a vacuum chamber 102. One end of the vacuum chamber terminates in a flange 104 attached to a high-voltage supply 106. Flange 104 is terminated with an O-ring 108 that allows for positional adjustments along the X and Y axes. A window 110 through which the high-power RF pulses 112 are emitted is positioned at the other end of vacuum chamber 102. An EM 114 is positioned around a portion of vacuum chamber 102 to produce a magnetic field 116 having field lines parallel to a longitudinal axis 118 (or Z-axis). A cathode stalk 120 serves to position a FE cathode 122 inside magnetic field 116 and to deliver high voltage pulses from high-voltage supply 106 to drive FE cathode 122 causing it to emit a pulsed annular electron beam 124. A SWS 126 such as described in U.S. Pat. No. 9,819,320 entitled "Coaxial Amplifier Device", issued Nov. 14, 2017 is fixed to the vacuum chamber 102 and is positioned such that the annular electron beam 124 is concentric with and closely spaced to the inner surface of the cylindrical SWS 126. As shown, the HPM vacuum tube source is configured as an oscillator to generate the RF pulses 112. Alternately, the source could be configured as an amplifier in which case an RF input could be injected through the vacuum chamber to enter the SWS near the location where the primary electron beam enters the SW S.

Adjustment mechanisms 130 are positioned toward opposite ends of vacuum chamber 102 and allow for translation of the vacuum chamber and SWS 126 along the X and Y axes. FE cathode 122 is fixed in X, Y and Z. Adjustment mechanisms 132 are positioned toward opposite ends of EM 114 and allow for an angular adjustment of magnetic field 116 in the XZ or YZ planes. These mechanisms can be used to roughly coaxially align the FE cathode 122, the SWS 126 and the magnetic field 116. A technician can "eyeball" the setup to roughly align the components. However, at typical power levels, to ensure proper operation of the source and to avoid damaging the SWS it is critical that the FE cathode 122, SWS 126 and magnetic field 116 are coaxially aligned to a tight tolerance. As shown in FIG. 2, if this tolerance is not maintained, electron beam 124 may strike the inner surface 128 of SWS 126 generating a plasma 202, pitting or burning the SWS at the beam strike 200. This can both damage the SWS as well as contaminate the SWS and vacuum chamber.

Referring now to FIGS. 3A-3B, a known method for aligning the HPM vacuum tube source 100 to satisfy the exacting coaxial alignment tolerance includes alternately placing sacrificial targets 300 and 302 at positions fore (towards FE cathode 122) and aft in SWS 126, firing FE cathode 122 to burn circles 304 and 306 into the targets, extracting positional information from the targets and controlling adjustment mechanisms 130 and 132 to make the fine translational and angular adjustments required to satisfy the coaxial alignment specification. This is a time consuming and expensive process that itself poses a risk of damaging the SWS and contaminating the vacuum chamber.

For each data point, a clean sacrificial target (e.g., steel or plastic) must be positioned in the SWS, vacuum must be pulled, the FE cathode fired to mark the target and the target removed to extract positional information. Each target is discarded after a single use. A pair of data points fore and aft are measured and used to calculate the translational and angular adjustments. These adjustments are made and the entire process is repeated multiple times to satisfy the alignment specification. The number of sacrificial targets is expensive as is the time to perform the alignment. Breaking and pulling vacuum for each measurement takes time and represents a contamination risk. Scarring the sacrificial targets generates contamination. If the rough "eyeball" alignment is not good enough, the FE cathode's high-power electron beam may strike and damage the inner wall of the SWS creating further damage, debris and contamination.

SUMMARY

The following is a summary that provides a basic understanding of some aspects of the disclosure. This summary is not intended to identify key or critical elements of the disclosure or to delineate the scope of the disclosure. Its sole purpose is to present some concepts of the disclosure in a simplified form as a prelude to the more detailed description and the defining claims that are presented later.

The present disclosure provides an HPM vacuum tube source and method of precise coaxial alignment of the high-power FE cathode, cylindrical RF generating tube (e.g., a slow wave structure (SWS) or resonant cavity) and magnet. A low-power thermionic emission (TE) cathode is positioned inside and coaxial with the high-power FE cathode in a "cathode-in-cathode" arrangement. With the HPM vacuum tube source under vacuum and the FE cathode deactivated, the TE cathode emits a continuous low-power surrogate electron beam. Measurement circuits measure the position of the surrogate electron beam with respect to a longitudinal axis fore and aft of the cylindrical RF generating tube. The measurement circuit is preferably reusable and capable of real-time continuous measurement, hence alignment adjustments. The measurement circuit may, for example, include a repositionable fluorescent target or electric (E) field sensors embedded in the cylindrical RE generating tube. The coaxial alignment of the FE cathode, cylindrical RF generating tube and magnet is adjusted manually or via computer control until the position of the low-power surrogate electron beam satisfies a coaxial alignment tolerance. This approach reduces the amount of time, number of times vacuum must be cycled and cost to align the HPM vacuum tube source as well as reducing the risk of damage or contamination to the HPM source and particularly the cylindrical RF generating tube.

In an embodiment, the FE cathode emits an annular high-power primary electron beam in discrete pulses that interact with the cylindrical RF to generate or amplify RF pulses. The FE cathode emits discrete pulses that are suitably <100 microseconds in duration and separated by at least 5× the pulse duration. When activated, the TI cathode emits a continuous low-power surrogate electron beam to facilitate real-time continuous measurement for alignment. The low-power surrogate electron beam diameter is suitably less than or equal to $1/10^{th}$ of the diameter of the high-power primary electron beam and the average power of the surrogate beam is less than $1/1000^{th}$ of the peak power of the primary beam.

In an embodiment, at each of the forward and aft measurement positions, multiple measurements and adjustments are made at each instance to improve the coaxial alignment tolerance. This 'in the loop' adjustment reduces the number of times vacuum must be cycled and thus reduces the total amount of time required for alignment and opportunities for contamination. In certain embodiments, the forward and aft measurement positions alternate. At the forward measurement position, at least translational adjustments are made between the FE cathode and the cylindrical RF generating tube orthogonal to the longitudinal axis. At the aft measurement position, at least angular adjustments of the magnet are made relative to the longitudinal axis. In other embodiments, the forward and aft measurements are made simultaneously and used to make both translational and angular adjustments.

In an embodiment, the measurements are made by repositioning a fluorescent target forward and aft. At each instance, vacuum is drawn and the TE cathode is activated to emit the surrogate electron beam to strike the fluorescent target causing it to fluoresce in a spot. The spot is visualized and translational or angular adjustments made to center the spot on the fluorescent target. The process is repeated until the spot positions satisfy the coaxial alignment tolerance.

In another embodiment, the measurements are made by embedded E field sensors in the cylindrical RF generating tube at the fore and aft positions. This configuration allows for either alternating or simultaneous measurement at the fore and aft positions. Furthermore, this configuration is highly amenable to periodic realignment of the source. In addition, the E field sensors can be used to measure and characterize the primary electron beam.

These and other features and advantages of the disclosure will be apparent to those skilled in the art from the following detailed description of preferred embodiments, taken together with the accompanying drawings, in which:

BRIEF DESCRIPTION OF THE DRAWINGS

FIGS. 3A and 31B, as described above, illustrate a method of coaxial alignment of the HPM source's primary cathode, SWS and magnetic field using the FE cathode's annular high-power electron beam;

DETAILED DESCRIPTION

Figure 1:
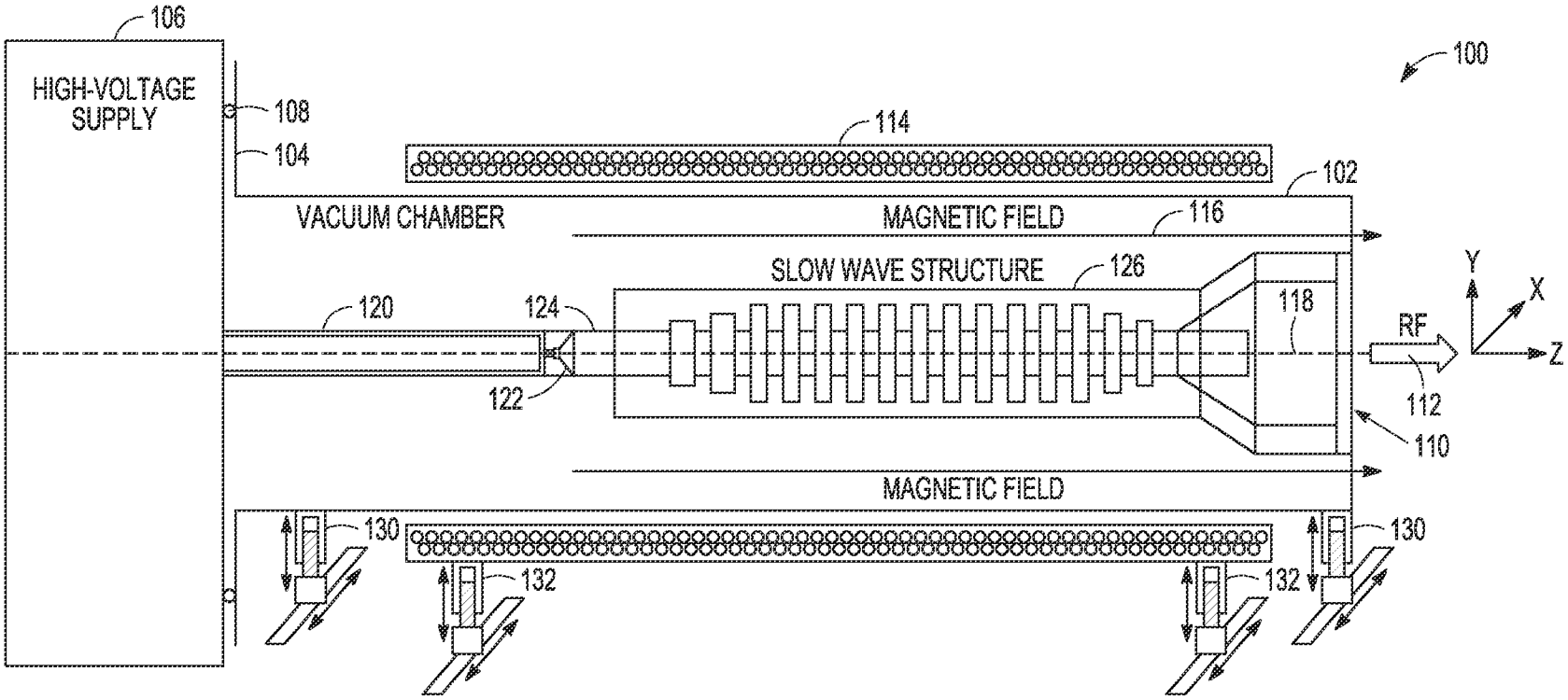
FIG. 1 (PRIOR ART)
FIG. 1, as described above, is a diagram of a HPM vacuum tube source.
Figure 2:
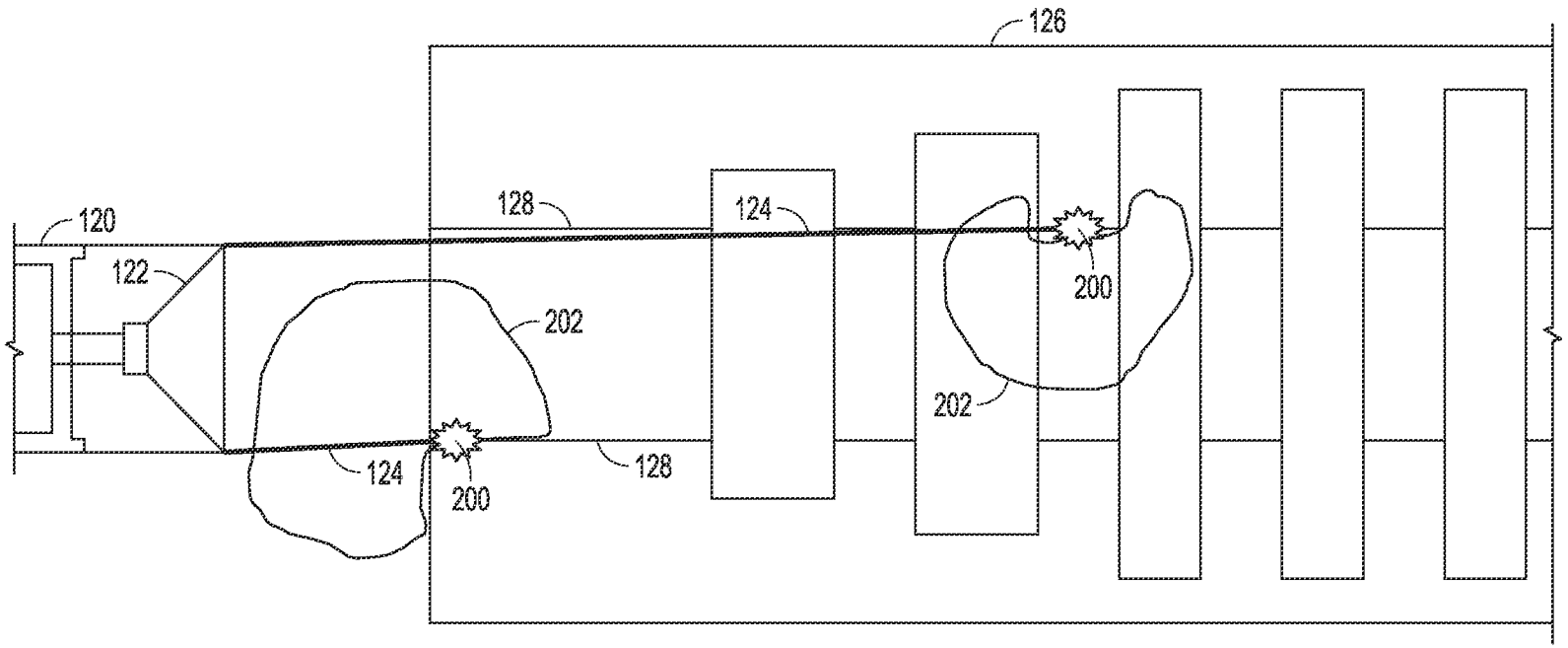
FIG. 2 (PRIOR ART)
FIG. 2, as described above, illustrates a risk of damaging the SWS when using the FE cathode's high-power annular electron beam.
Figure 3A:
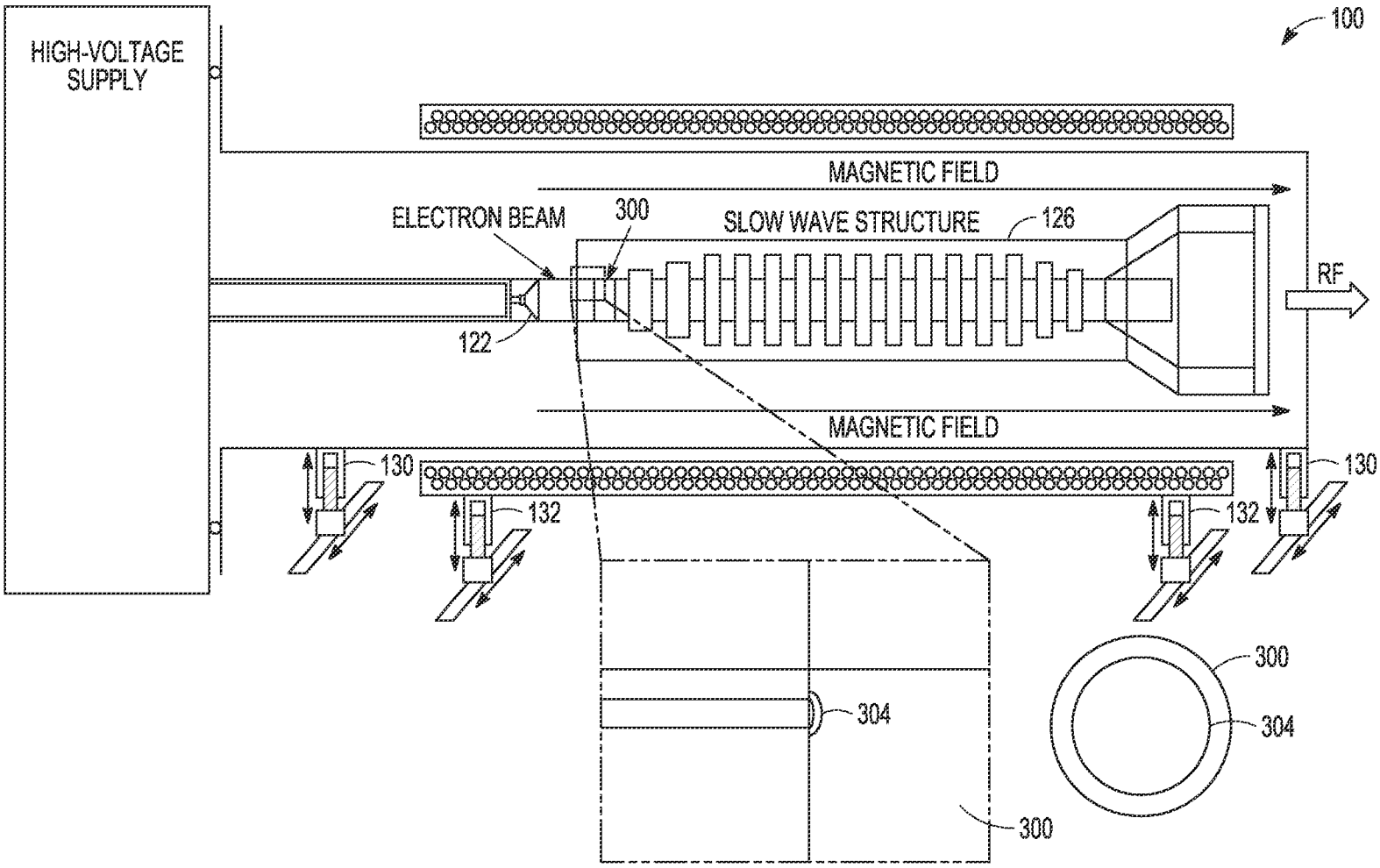
FIG. 3A (PRIOR ART)
Figure 3B:
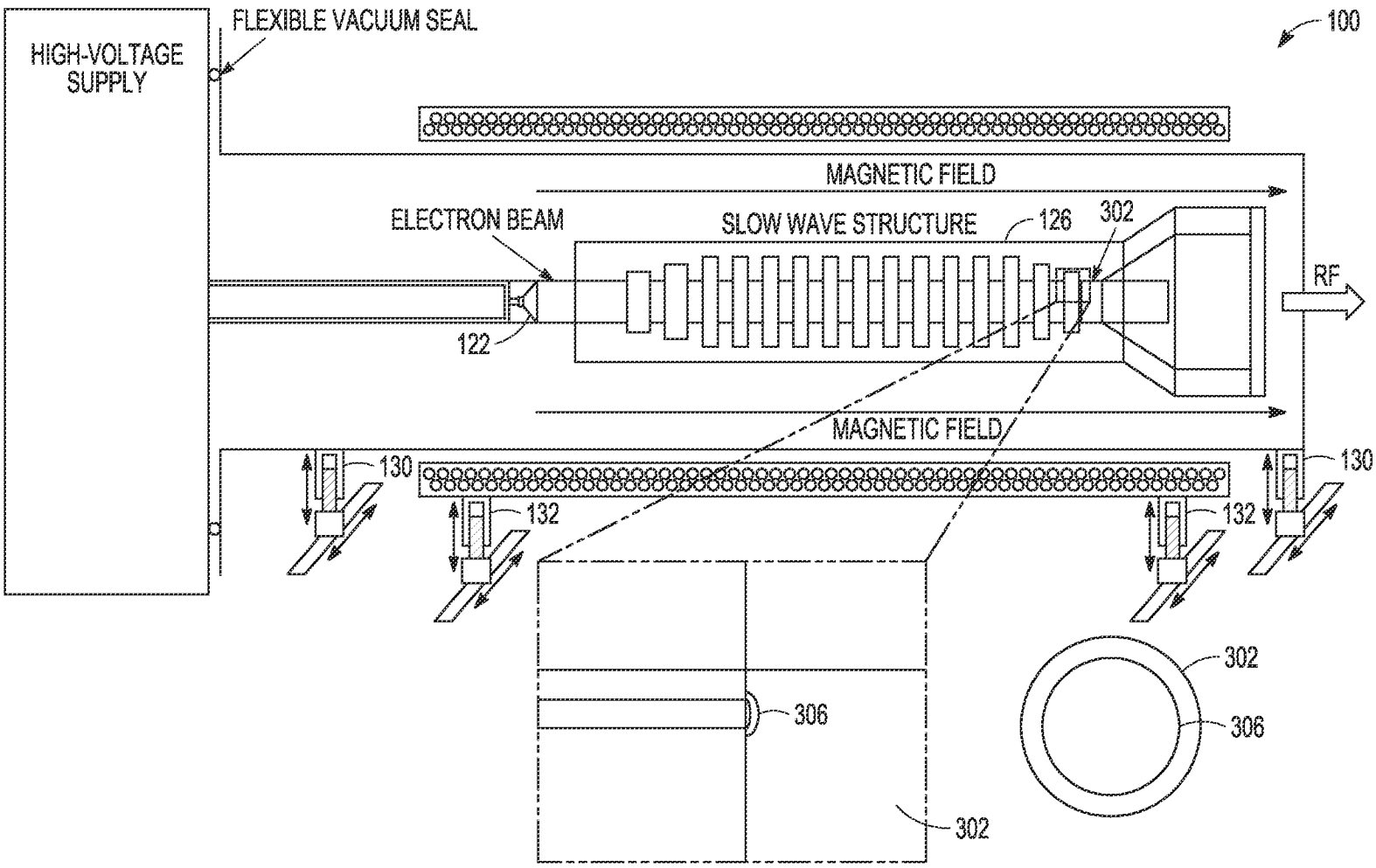
FIG. 3B (PRIOR ART)

The present disclosure describes a HPM vacuum tube source and method of precise coaxial alignment of the FE cathode, cylindrical RF generating tube and magnet includes positioning a low-power TE cathode inside the FE cathode in a "cathode-in-cathode" arrangement. With the RPM source under vacuum and the FE cathode deactivated, the TE cathode emits a surrogate electron beam. Measurement circuits measure the beam's position with respect to a longitudinal axis fore and aft of the cylindrical RE generating tube. The measurements circuits may, for example, be a repositionable fluorescent target or electric field sensors embedded in the cylindrical RF generating tube. The coaxial alignment of the FE cathode, cylindrical RF generating tube and magnet is adjusted until the position of the surrogate electron beam satisfies a coaxial alignment tolerance.

The "cathode-in-cathode" arrangement includes a TE cathode placed deep inside the apex of the FE cathode. The FE cathode and TE cathode never operate at the same time. During alignment, the FE cathode is inactive, hence will not affect TE cathode operation nor risk damaging or contamination due to the high-power primary electron beam. During normal operation, the electric fields during FE cathode operation are low, and the presence of the cold TE cathode will not affect FE cathode operation.

In an embodiment, the FE cathode emits an annular high-power primary electron beam in discrete pulses that are suitably 100 microseconds in duration and separated by at least 5× the pulse duration. By comparison, when activated the TE cathode emits a continuous low-power surrogate electron beam, which is typically a solid "pencil" beam. The low-power surrogate electron beam diameter is suitably less than or equal to $1/10^{th}$ of the diameter of the annular high-power primary electron beam and the average power of the surrogate electron beam is less than $1/1000^{th}$ the peak power of the discrete pulses.

FE cathodes use an electric field to force electrons from the atoms in the cathode material and out into the vacuum space just external to the cathode where they are accelerated by the magnetic field. FE cathodes have very sharp geometries to cause the applied electric potential to concentrate at the sharp emission edges. This results in field strengths capable of causing the electrons in the cathode material to concentrate in the sharp knife edges to such an extent that their quantum wave functions begin to exist partially outside the material of the cathode edge. At that point, electrons begin barrier tunneling out of the cathode into the adjacent vacuum where they are now repelled by the cathode's strong negative charge. Once this process begins, very large currents can flow from the cathode, depending on the power source.

TE cathodes operate by thermally heating the cathode. Depending on the cathode material (and its characteristic work function) temperatures in the 900 to 2000 C range (orange to yellow/white heat) are typically required. At these temperatures, the thermal jostling of the atoms in the cathode material is sufficient to spall electrons loose from the atoms in the cathode material. If, at this point, a negative charge is applied to this hot cathode, the loose electrons are repelled from the cathode into the vacuum space of the tube. TE cathodes typically are not capable of supplying the large quantities of current that FE cathodes can. However, they also require much less voltage to operate and emit electrons compared to large FE cathodes.

The cathode-in-cathode arrangement may be used in any HPM vacuum tube source to facilitate alignment of the FE cathode, cylindrical RF generating tube and magnetic field in which the FE cathode and generating tube are positioned in a vacuum chamber. The source may be configured as an oscillator or as an amplifier. The cylindrical RF generating tube may be a SWS or resonant cavity. In general, the alignment mechanisms must be capable of translation in the X and Y axes sufficient to coaxially align the FE cathode, generating tube and magnetic field. In one embodiment, the vacuum tube and integrally formed generating tube may be translated in the X and Y axis and the magnetic adjusted angularly in the XZ and YZ planes. In other embodiments, the components may be arranged such that the FE cathode can be adjusted.

Figure 4:
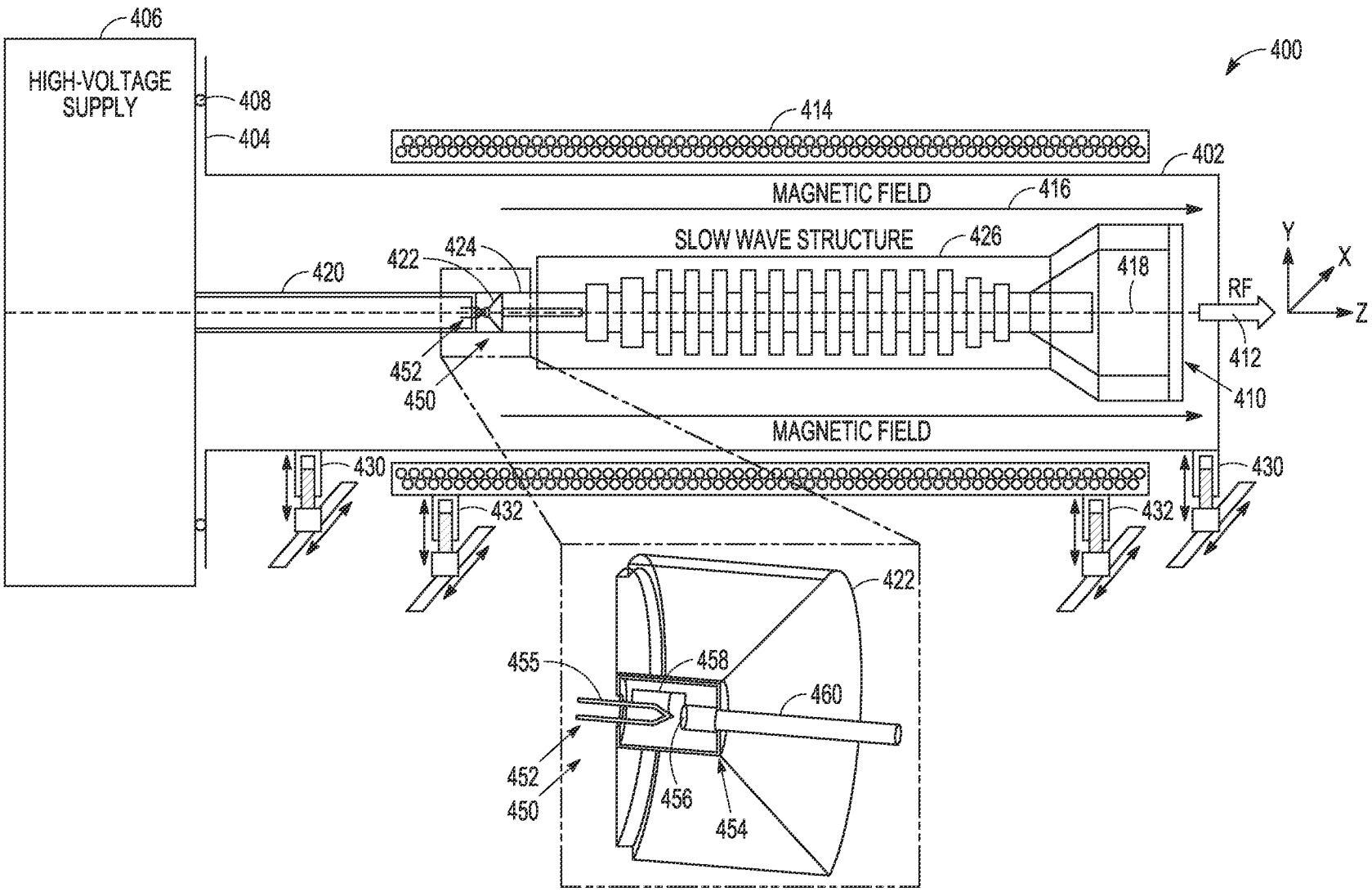
FIG. 4 is a diagram of an embodiment of a cathode-in-cathode HPM vacuum tube source in which a low-power TE cathode is placed inside the FE cathode for purposes of alignment.

Referring now to FIG. 4, an embodiment of an RPM vacuum tube source 400 includes a cathode-in-cathode arrangement for performing alignment and for normal operation. One end of a vacuum chamber 402 (integral portion of the vacuum tube) terminates in a flange 404 attached to a high-voltage supply 406. Flange 404 is terminated with an O-ring 408 that allows for positional adjustments along the X and Y axes. A window 410 through which the high-power RF pulses 412 are emitted is positioned at the other end of vacuum chamber 402. An EM 414 is positioned around a portion of vacuum chamber 402 to produce a magnetic field 416 having field lines parallel to a longitudinal axis 418 (or Z-axis).

A cathode stalk 420 serves to position a cathode-in-cathode structure 450 inside magnetic field 416. Cathode-in-cathode structure 450 includes a FE cathode 422 and a TE cathode 452 positioned deep inside the apex 454 of FE cathode 422. TE cathode 452 includes a heating element 455, a cathode 456 and a wire 458 that connects the heating element to the cathode 456. When activated, high voltage pulses from high-voltage supply 406 are delivered along the exterior of cathode stalk 420 to FE cathode 422 causing it to emit a pulsed annular electron beam 424. When activated, a low voltage is delivered via wires through the interior of cathode stalk 420 to heating element 454 causing cathode 456 to emit a continuous low-power surrogate electron beam 460. The low-power surrogate electron beam diameter is suitably less than or equal to $1/10^{th}$ of the diameter of the annular high-power primary electron beam 424 and less than $1/1000^{th}$ it's peak power.

A SWS 426 such as described in U.S. Pat. No. 9,819,320 entitled "Coaxial Amplifier Device", issued Nov. 14, 2017 is fixed to the vacuum chamber 402 and is positioned such that the annular electron beam 424 is concentric with and closely spaced to the inner surface of SWS 426. The surrogate electron beam 460 nominally travels along longitudinal axis 418. As shown, the RPM vacuum tube source is configured as an oscillator to generate the RF pulses 412. Alternately, the source could be configured as an amplifier in which case an RF input could be injected through the vacuum chamber to enter the SWS near the location where the primary electron beam enters the SWS.

Adjustment mechanisms 430 are positioned toward opposite ends of vacuum chamber 402 and allow for translation of the vacuum chamber and SWS 426 along the X and Y axes. FE cathode 422 is fixed in X, Y and Z. Adjustment mechanisms 432 are positioned toward opposite ends of EM 414 and allow for an angular adjustment of magnetic field 416 in the XZ or YZ planes. These mechanisms can be used to roughly coaxially align the FE cathode 422, the SWS 426 and the magnetic field 416. A technician can "eyeball" the setup to roughly align the components. However, at typical power levels, to ensure proper operation of the source and to avoid damaging the SWS it is critical that the FE cathode 422, SWS 426 and magnetic field 416 are coaxially aligned to a tight tolerance. The cathode-in-cathode structure 450 and particularly the TE cathode 452 will be used to perform the precise coaxial alignment.

Figure 5:
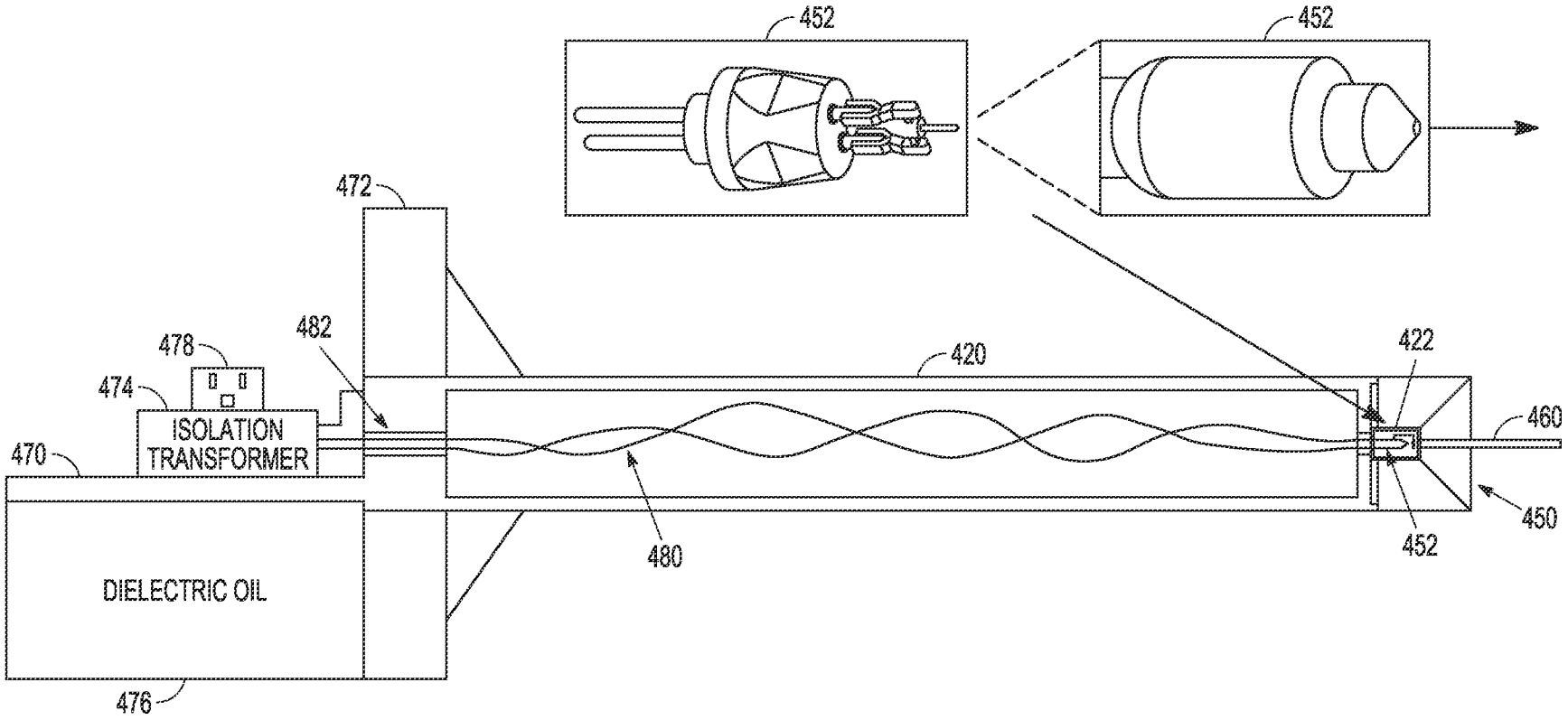
FIG. 5 is a diagram of an embodiment of the cathode-in-cathode structure.

Referring now to FIG. 5, cathode stalk 420 both extends the cathode-in-cathode structure 450 into the magnetic field and delivers the required drive voltages to the FE cathode 422 and TE cathode 452. The high-voltage supply distributes a high voltage pulse along a conductor 470 through a cathode insulator plate 472 along the exterior of the cathode stalk 420 to the FE cathode 422. An isolation transformer 474 is positioned outside the vacuum chamber in dielectric oil 476 with conductor 470, and is coupled to an external power source via a plug 478 such as a 110 V plug. Electrical wires 480 from the isolation transformer pass through a hermetic seal 482 in insulator plate 472 along the interior of the cathode stalk 420 to bring a drive voltage to the TE cathode's heater 455.

The FE cathode 422 and TE cathode 452 never operate at the same time. During source alignment, the FE cathode 422 is deactivated and the high voltage pulse is not applied to the FE cathode. During normal source operation, the isolation transformer 474 is decoupled from external power and the isolation transformer 474 and TE cathode 452 float at the voltage fed to the FE cathode 422. The TE cathode 442 resides down inside the apex of the FE cathode 422. There, the electric fields during FE operation are low, and the presence of the TE cathode 452 will not affect FE cathode operation. The wires 480 connecting the transformer 474 to the TE cathode 452 run up the interior of the FE's cathode stalk 420, where they are essentially invisible to FE operation. When alignment is needed, a removable power cord is attached to the isolation transformer 474 to power it tip and begin emission of the surrogate electron beam 460 for use in alignment. Conversely, during normal tube operation, the TE cathode 450 is unpowered and cold. With the power cord removed from the isolation transformer 474, the transformer and TE cathode simply float harmlessly at whatever voltage is fed to the FE cathode for tube operation.

Figure 6:
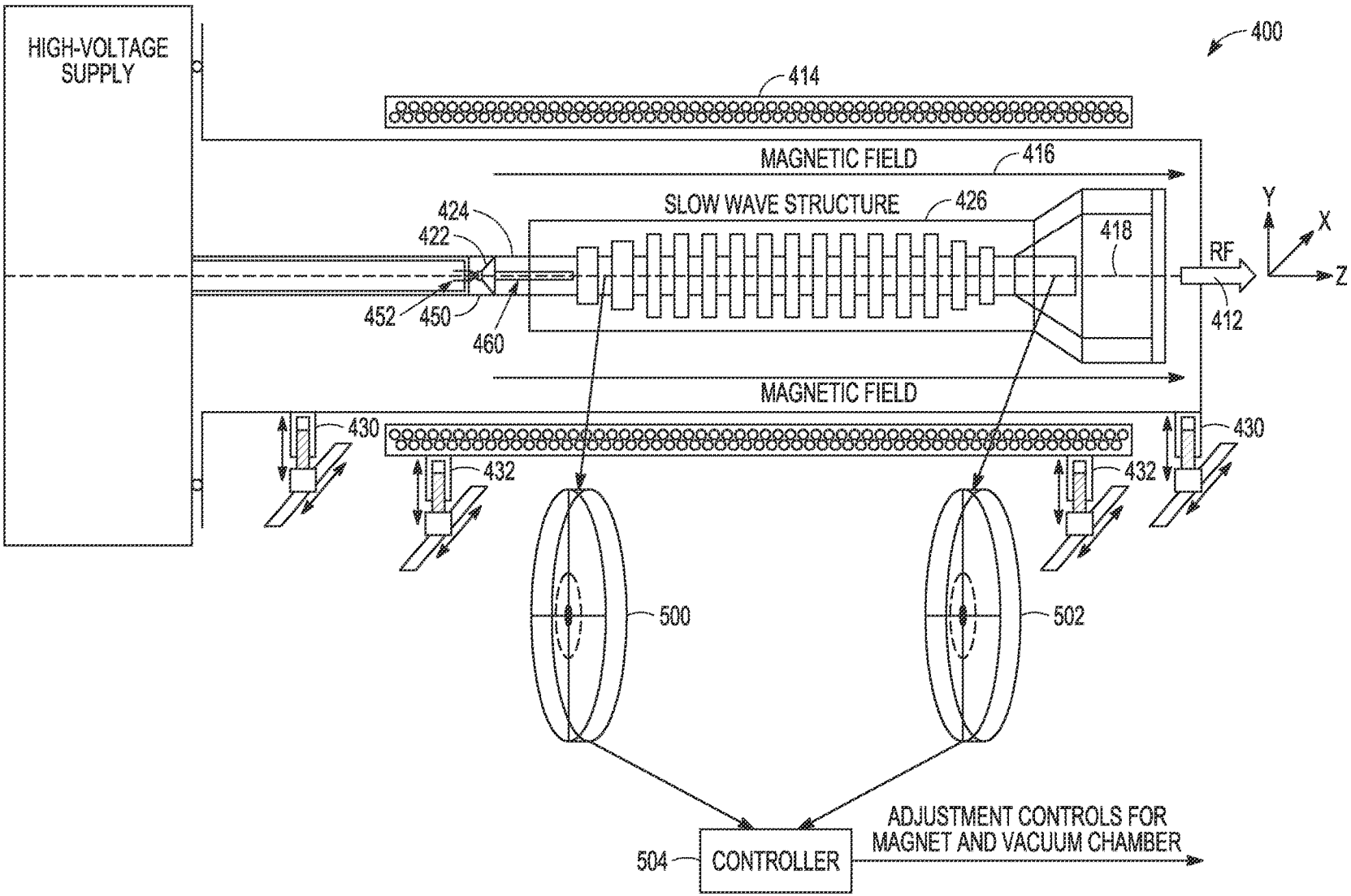
FIG. 6 is a diagram of an embodiment for measuring the position of the low-power surrogate electron beam at positions fore and aft of the SWS to align the HPM source.

Referring now to FIG. 6, to precisely align the HPM vacuum tube source 400 with the cathode-in-cathode structure 450 to meet a stringent coaxial alignment tolerance, measurement circuits 500 and 502 are positioned at locations fore and aft in SW S 426 either in an alternating sequence or at the same time. With the FE cathode 422 deactivated, the TE cathode 452 is activated and driven to emit the surrogate electron beam 460. Measurement circuits 500 and 502 measure the position of surrogate electron beam 460 with respect to longitudinal axis (Z axis) 418 at the fore and aft positions. Alignment mechanisms 430 and 432 are used to adjust the alignment of the FE cathode 422, SWS 426 and magnet 414 until the position of the surrogate electron beam 460 at the positions fore and aft satisfies a coaxial alignment tolerance. The measurement circuits typically make multiple measurements to facilitate multiple adjustments. In different configurations, the position measurements may be read out visually by a human or automated camera system or electronically represented by controller 504. Similarly, the adjustment mechanisms may be controlled by a human or an automated system coupled to controller 504.

Since the forward measurement is closest to the FE cathode 422, it is more likely to show translational errors between the FE cathode 422 and the input to the SWS 426. Tilt errors between the FE cathode 422 and the SWS 426 are unlikely by virtue of simple machining tolerances. The fore measurement may show very gross magnet alignment errors, but the relatively short travel distance from the FE cathode 422 to the forward measurement circuit make magnet tilt errors hard to detect. On the other hand, the aft measurement is significantly further away, making angular misalignments with the magnetic field easier to detect and correct. Consequently, a typical approach is to use alignment mechanisms 430 to translate the vacuum tube, hence SWS 426 in the X and Y axes to improve coaxial alignment and alignment mechanisms 432 to make angular adjustments to magnet 414 in the XZ and YZ planes to improve coaxial alignment.

Figure 7A:
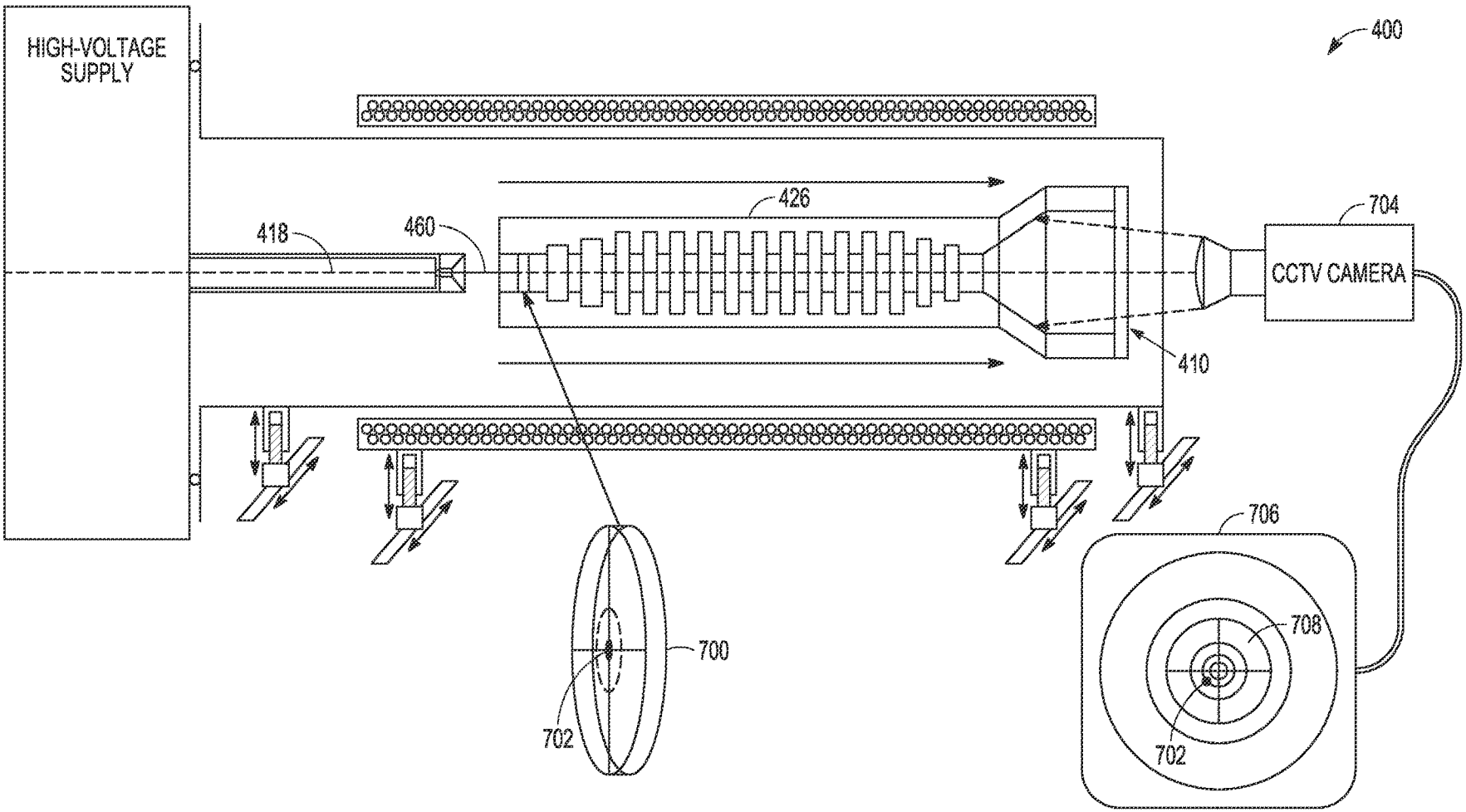
FIGS. 7A-7B are diagrams illustrating the use of a fluorescent target alternately positioned fore and aft of the SWS with a visual readout of the surrogate electron beam position to align the HPM source.
Figure 7B:
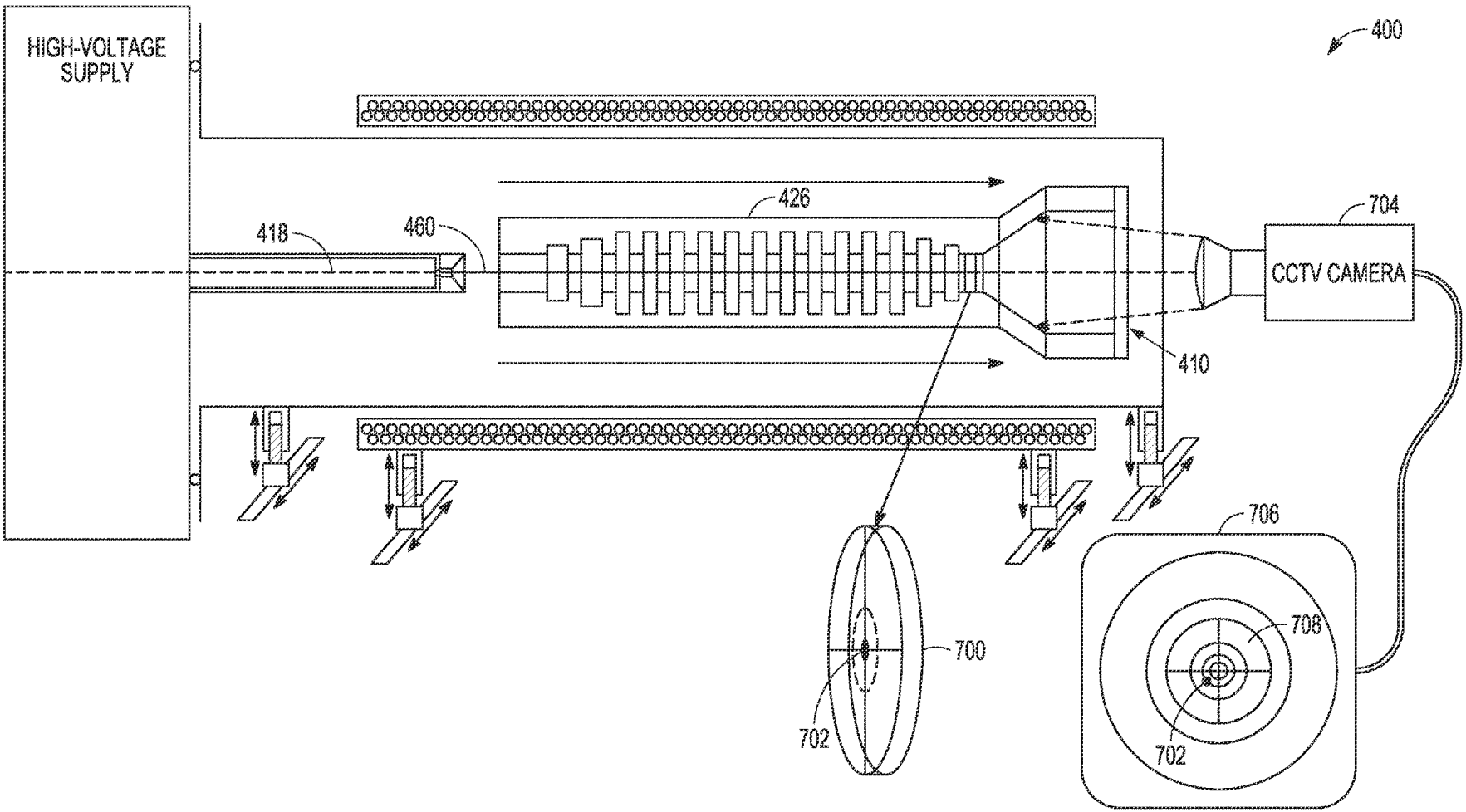
Figure 8:
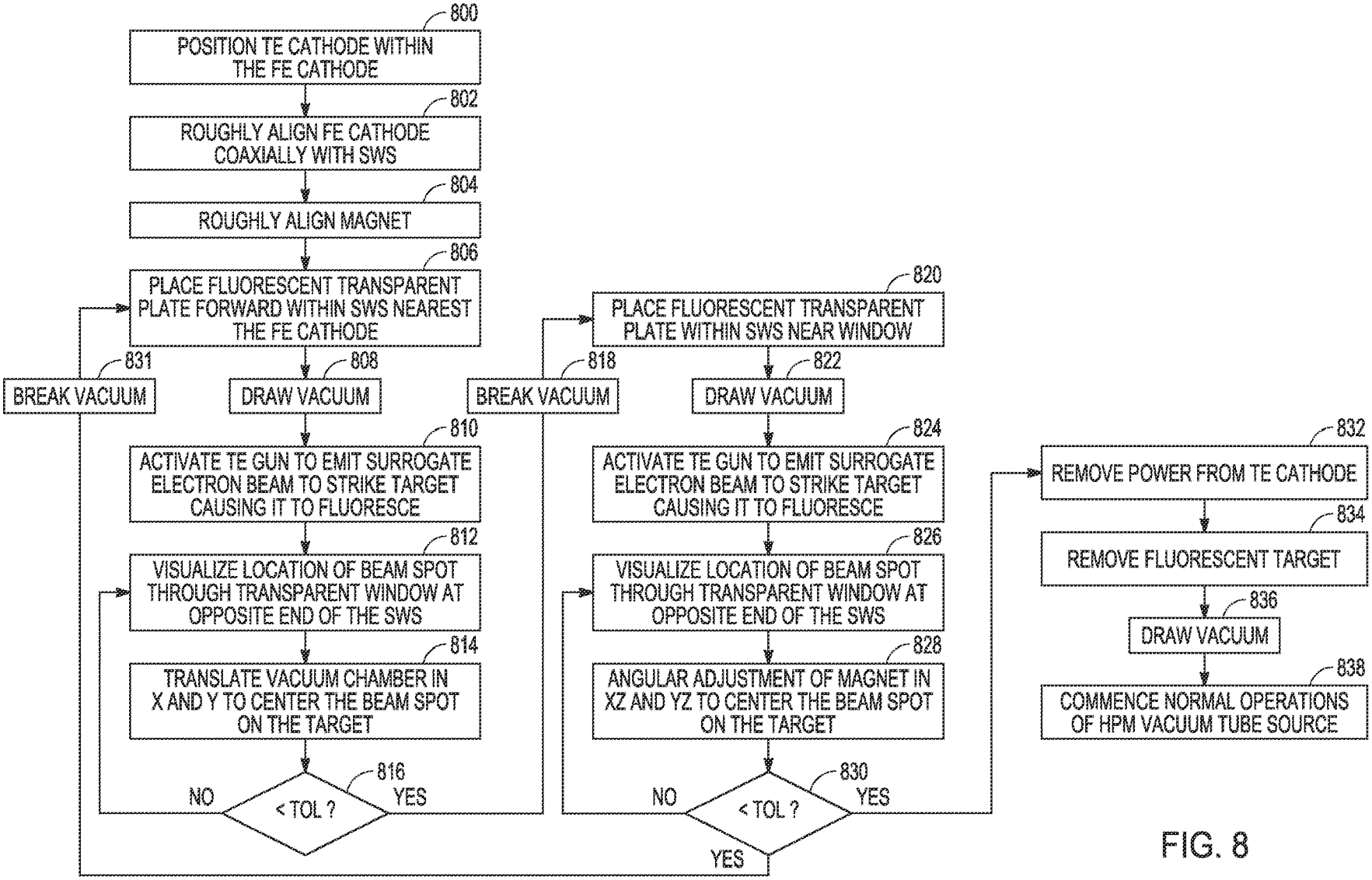
FIG. 8 is an embodiment of a method of alignment using the low-power TE cathode and repositionable fluorescent target.

Referring now to FIGS. 7A-7B and 8, an embodiment of a HPM vacuum tube source 400 and method of alignment alternately positions a fluorescent target 700 at fore and aft positions in SWS 426. The fluorescent target 700 is very similar to what might be found in an old CRT TV. When target 700 is struck by the surrogate electron beam of the correct energy it fluoresces to form a visible beam spot 702. A camera 704 is positioned to look through window 410 down the internal bore of SWS 426. Camera 704 can visualize and display an image 706 of an alignment reticle 708 and beam spot 702. Translational and angular adjustments can be made to center beam spot 702 on reticle 708 at the fore and aft positions.

In a particular embodiment, a TE cathode is positioned deep with the apex of FE cathode to form a "cathode-in-cathode" structure (step 800). To align the HPM vacuum source, first the FE cathode, SWS and magnet are visually and roughly aligned. More specifically, the FE cathode and cylindrical RF generating tube are roughly coaxially aligned such that a cathode face appears to be visually centered within an internal bore of the SWS when viewed from a far end of the SWS (step 802) and the magnetic is roughly aligned such that the magnetic field is approximately coaxial with the FE cathode and the cylindrical RF generating tube by visually adjusting the magnet until the exterior of the cylindrical RF generating tube appears to be concentric within a bore of the magnet (step 804).

The fluorescent target is placed forward in the SWS towards the FE cathode (step 806). Vacuum is drawn on the vacuum chamber (step 808) and the TE gun is activated to emit the surrogate electron beam to strike the fluorescent target causing it to fluoresce in a beam spot (step 810). The camera visualizes the location of the beam spot through the transparent window at the opposite end of the SWS (step 812). The adjustment mechanisms are controlled to translate the vacuum chamber, hence SWS in the X or Y axes to center the beam spot on the target (step 814). Steps 812 and 814 are repeated until the beam spot is within a tolerance of the center of reticle or a fixed number of iterations (step 816).

Vacuum is broken (step 818) and the fluorescent target is removed and placed aft in the SWS towards the window (step 820). Equivalently, a different fluorescent target could be used. Vacuum is drawn on the vacuum chamber (step 822) and the TE gun is activated to emit the surrogate electron beam to strike the fluorescent target causing it to fluoresce in a beam spot (step 824). The camera visualizes the location of the bean spot through the transparent window at the opposite end of the SWS (step 826). The adjustment mechanisms are controlled to angularly adjust the magnet in the XZ or YZ planes to center the beam spot on the target (step 828). Steps 826 and 828 are repeated until the beam spot is within a tolerance of the center of reticle or a fixed number of iterations (step 830).

On the first pass through the fore and aft measurement positions it is quite likely that the beam spot will not converge to the final coaxial alignment tolerance. This can be handled by repeating the measurement and adjustment steps a fixed number of times before moving or by starting with a larger tolerance and reducing it with each pass until the final coaxial alignment tolerance can be achieved. On the next pass, break vacuum (step 831) and repeat starting at step 806.

When the final coaxial alignment tolerances are achieved at the fore and aft positions power is removed from the TE cathode (step 832) and the fluorescent target is removed from the source (step 834). Vacuum is drawn (step 836) and normal operation of the HPM vacuum source commences (step 838) by activating the FE cathode.

Figure 9:
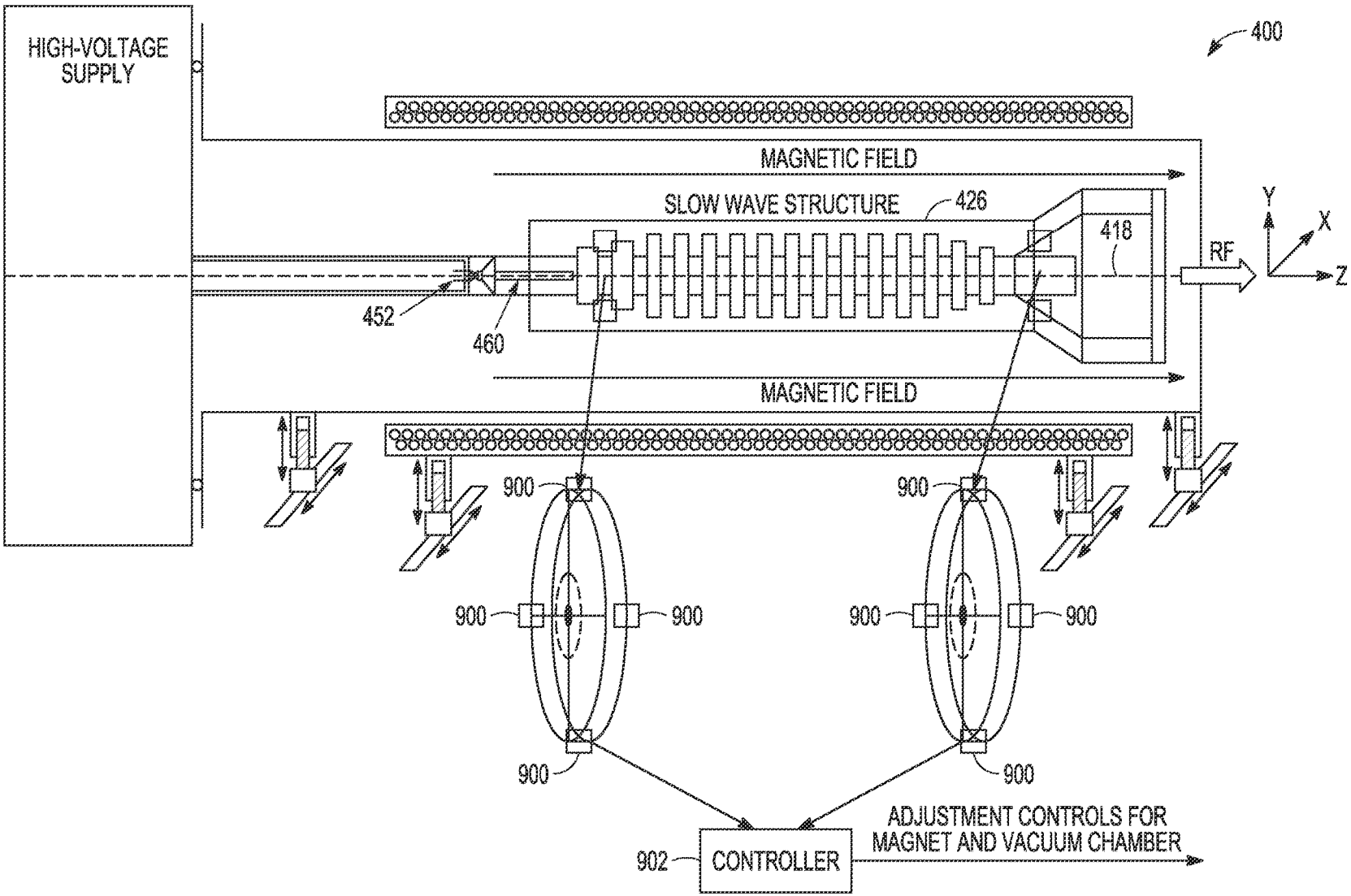
FIG. 9 is a diagram illustrating the use of E field sensors embedded fore and aft in the SWS to measure surrogate electron beam position.
Figure 10:
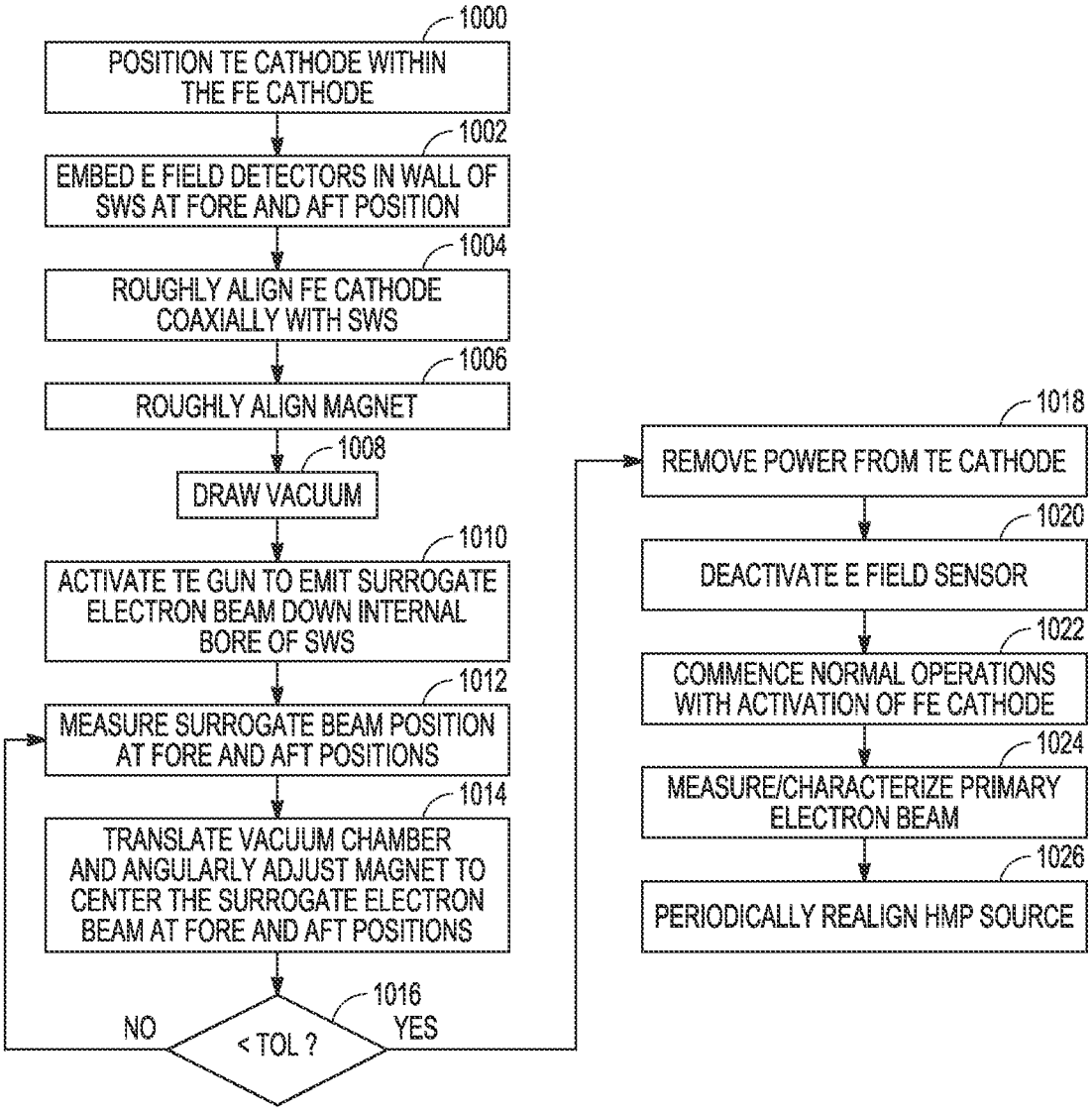
FIG. 10 is an embodiment of method of alignment using the low-power TIE cathode and E field sensors.

Referring now to FIGS. 9 and 10, an embodiment of a HPM vacuum tube source 400 and method of alignment embeds E field sensors 900 at fore and aft positions in SWS 426. The TE cathode 452 emits the surrogate electron beam 460 through the internal bore of the SWS 426. If the beam is perfectly aligned to the SWS's longitudinal axis 418 than the E field sensors 900 at the fore position should measure the same E field strength and E field sensors 900 at the fore position should measure the same E field strength indicating that the surrogate electron beam is perfectly coaxially aligned with the SWS. As the surrogate electron beam translates or tilts away from the longitudinal axis or the magnetic field is misaligned the E field sensors 900 at each of the fore and aft positions will reflect that by measuring different E field strengths. The position of the surrogate electron beam can be computed from the different E field strengths by a controller 902 that subsequently determines the appropriate translational and angular adjustments.

In a particular embodiment, a TE cathode is positioned deep with the apex of FE cathode to form a "cathode-in-cathode" structure (step 1000) and E field sensors are embedded in the walls of the SWS at the fore and aft positions (step 1002) To align the RPM vacuum source, first the FE cathode, SWS and magnet are visually and roughly aligned. More specifically, the FE cathode and cylindrical RF generating tube are roughly coaxially aligned such that a cathode face appears to be visually centered within an internal bore of the SWS when viewed from a far end of the SWS (step 1004) and the magnetic is roughly aligned such that the magnetic field is approximately coaxial with the FE cathode and the cylindrical RF generating tube by visually adjusting the magnet until the exterior of the cylindrical RF generating tube appears to be concentric within a bore of the magnet (step 1006).

Vacuum is drawn on the vacuum chamber (step 1008) and the TE gun is activated to emit the surrogate electron beam down the internal bore of the SWS through the window (step 1010). The E field sensors are used to measure the position of the surrogate electron beam with respect to the longitudinal axis at the fore and aft positions (step 1012). The adjustment mechanisms are controlled to translate the vacuum chamber, hence SWS in the X or Y axes and to angularly adjust the magnet to center the surrogate electron beam at the fore and aft positions. Steps 1012 and 1014 are repeated until the surrogate electron beam is within a tolerance of coaxial alignment (step 1016).

Once coaxial alignment is achieved, power is removed from the TE cathode (step 1018) and the E field sensors may be deactivated (step 1020). Normal operation of the RPM vacuum tube source commences with activation of the FE cathode (step 1022).

Embedding of the E field sensors in the SWS has several potential advantages. First, vacuum does not have to be broken and drawn to perform the alignment. This reduces the amount of time required to perform alignment and eliminates the risk of contamination due to breaking vacuum. Second, the E field sensors can be reactivated and used to measure and characterize the primary electron beam (step 1024). Finally, the FE cathode can be deactivated and the TE cathode reactivated without having to cycle the vacuum to periodically realign the RPM vacuum tube source (step 1026).

While several illustrative embodiments of the disclosure have been shown and described, numerous variations and alternate embodiments will occur to those skilled in the art. Such variations and alternate embodiments are contemplated, and can be made without departing from the spirit and scope of the disclosure as defined in the appended claims.

We claim:

1. A method of aligning a high-power microwave (HPM) vacuum tube source, said source including a magnet configured to produce a magnetic field, a field emission (FE) cathode configured to emit an annular high-power primary electron beam, and a cylindrical RF generating tube configured to interact with the primary electron beam to generate or amplify an RF signal, the method comprising:

positioning a thermionic emission (TE) cathode inside the FE cathode, said TE cathode configured to emit a low-power surrogate electron beam coaxially with the primary electron beam;

with the source under vacuum and the FE cathode deactivated, activating the TE cathode to emit the surrogate electron beam;

measuring the position of the surrogate electron beam with respect to a longitudinal axis of the cylindrical RF generating tube at positions fore and aft on the cylindrical RF generating tube; and adjusting the alignment of the FE cathode, cylindrical RF generating tube and magnet until the position of the surrogate electron beam at the positions fore and aft satisfies a coaxial alignment tolerance.

2. The method of claim 1, prior to activating the TE cathode, further comprising:

roughly coaxially aligning the FE cathode and cylindrical RF generating tube such that a cathode face appears to be visually centered within an internal bore of the RE generating tube when viewed from a far end of the RF generating tube; and roughly aligning the magnet such that the magnetic field is approximately coaxial with the FE cathode and the cylindrical RF generating tube by visually adjusting the magnet until the exterior of the cylindrical RF generating tube appears to be concentric within a bore of the magnet.

3. The method of claim 1, wherein the FE cathode emits the primary electron beam as discrete pulses have a pulse duration of less than 100 microseconds and a duration between pulses of at least 5× the pulse duration, wherein the TE cathode emits the surrogate electron beam in a diameter less than or equal to 1/10th of the diameter of the primary electron beam and an average power less than 1/1,000th the peak power of the discrete pulses.

4. The method of claim 1, wherein the source further comprises a cathode stalk configured to position the FE cathode and TE cathode therein inside the magnetic field, wherein during source alignment, a drive voltage is coupled from an isolation transformer via wires along the interior of the cathode stalk to the heater of the TE cathode; and wherein during normal source operation, high voltage pulses are coupled along the exterior of the cathode stalk to the FE cathode, the isolation transformer and TE cathode float at the voltage fed to the FE cathode.

5. The method of claim 1, wherein at each of the forward and aft measurement positions, multiple measurements and adjustments are made at each instance to improve the coaxial alignment tolerance.

6. The method of claim 5, wherein the forward and aft measurement positions alternate, wherein adjusting the alignment comprises:

at the forward measurement position, making at least translational adjustments between the FE cathode and the cylindrical RF generating tube orthogonal to the longitudinal axis; and at the aft measurement position, making at least angular adjustments of the magnet relative to the longitudinal axis.

7. The method of claim 5, wherein the forward and aft measurements are made simultaneously, wherein adjusting the alignment comprises:

making at least translational adjustments between the FE cathode and the cylindrical RF generating tube orthogonal to the longitudinal axis and making at least angular adjustments of the magnet relative to the longitudinal axis.

8. The method of claim 1, wherein the position of the surrogate electron beam is measured fore and aft by (a) positioning a fluorescent target on the cylindrical RF generating tube towards the FE cathode, drawing a vacuum on the source, activating the TE cathode to emit the surrogate electron beam to strike the fluorescent target causing it to fluoresce in a spot, visualizing the spot through the cylindrical RF generating tube to measure the position of the surrogate electron beam and adjusting the alignment of the FE cathode, cylindrical RF generating tube and magnet to center the spot on the fluorescent target;

(b) breaking vacuum and removing the fluorescent target;

(c) positioning the fluorescent target aft on the cylindrical RF generating tube, drawing a vacuum on the source, activating the TE cathode to emit the surrogate beam to strike the fluorescent target causing it to fluoresce in a spot, visualizing the spot to measure the position of the surrogate electron beam and adjusting the alignment of the FE cathode, cylindrical RF generating tube and magnet to center the spot on the fluorescent target; and repeating steps (a)-(c) until measured position of the surrogate electron beam satisfies a coaxial alignment.

9. The method of claim 8, wherein with the fluorescent target positioned towards the FE cathode, alignment comprises adjusting at least translational positions of the FE cathode or cylindrical RF generate tube orthogonal to the longitudinal axis, wherein with the fluorescent target positioned aft on the cylindrical generating tube, alignment comprises adjusting at least an angular position of the magnet relative to the longitudinal axis.

10. The method of claim 1, further comprising embedding electric field sensors in the cylindric RF generating tube at the fore and aft positions to measure the positions of the surrogate electron.

11. The method of claim 10, wherein alignment comprises adjusting at least translational positions of the FE cathode or cylindrical RF generate tube orthogonal to the longitudinal axis and adjusting at least an angular position of the magnet relative to the longitudinal axis.

12. The method of claim 10, further comprising: once aligned, periodically deactivating the FE cathode and using the TE cathode to realign the HPM vacuum tube source.

13. The method of claim 10, further comprising: once aligned, activating the FE cathode and using the embedded electric field sensors to measure the primary electron beam.

14. A high-power microwave (HPM) vacuum tube source, comprising: a magnetic configured to produce a magnetic field; a field emission (FE) cathode configured to emit an annular high-power primary electron beam in discrete pulses; a cylindrical RF generating tube along a longitudinal axis configured to interact with the primary electron beam to generate or amplify a pulsed RF signal; a thermionic emission (TE) cathode positioned inside and coaxial with the FE cathode, said TE cathode configured to emit a low-power surrogate beam as a continuous beam; and adjustment mechanisms responsive to position measurements of the surrogate beam fore and aft of the cylindrical RF generating tube to adjust the alignment of the FE cathode, cylindrical RF generating tube and magnet until the position measurements satisfy a coaxial alignment tolerance.

15. The HPM vacuum tube source of claim 14, wherein the FE cathode emits the primary electron beam as discrete pulses have a pulse duration of less than 100 microseconds and a duration between pulses of at least 5× the pulse duration, wherein the TE cathode emits the surrogate electron beam in a diameter less than or equal to 1/10th of the diameter of the primary electron beam and an average power less than 1/1,000th the peak power of the discrete pulses.

16. The RPM vacuum tube source of claim 14, wherein the source further comprises:

a cathode stalk configured to position the FE cathode and TE cathode therein inside the magnetic field;

a conductor coupled to the cathode stalk to bring a high voltage pulse along the exterior of the cathode stalk to the FE cathode;

an isolation transformer for coupling to external power;

electrical wires coupled from the isolation transformer along the interior of the cathode stalk to bring a drive voltage to a heater of the TE cathode, wherein during source alignment the high voltage pulse is not applied to the FE cathode;

wherein during normal source operation, the isolation transformer is decoupled from external power and the isolation transformer and TE cathode float at the voltage fed to the FE cathode.

17. The HPM vacuum tube source of claim 14, wherein at each of the forward and aft measurement positions, the adjustment mechanisms are responsive to multiple measurements to improve the coaxial alignment tolerance.

18. The HPM vacuum tube source of claim 14, further comprising a fluorescent target alternately positioned fore and aft of the cylindrical RF generating tube, said fluorescent target responsive to the surrogate electron beam to fluoresce in a spot to measure the position of the surrogate electron beam.

19. The HPM vacuum tube source of claim 14, further comprising a plurality of electric field sensors embedded in the cylindric RIF generating tube at the fore and aft positions to measure the position of the surrogate electron beam.

20. A method of aligning a high-power microwave (FPM) vacuum tube source, said source including a magnet to produce a magnetic field, a field emission (FE) cathode configured to emit an annular high-power primary electron beam, and a cylindrical RE generating tube configured to interact with the primary electron beam to generate or amplify an RF signal, the method comprising:

roughly coaxially aligning the FE cathode and cylindrical RF generating tube such that a cathode face appears to be visually centered within an internal bore of the cylindrical RF generating tube when viewed from a far end of the cylindrical RF generating tube;

roughly aligning the magnet such that the magnetic field is approximately coaxial with the FE cathode and the cylindrical RF generating tube by visually adjusting the magnet until the exterior of the cylindrical RE generating tube appears to be concentric within a bore of the magnet;

precisely coaxially aligning the FE cathode, cylindrical RF generating tube and magnetic field with the FE cathode deactivated by, (a) positioning a thermionic emission (TE) cathode inside the FE cathode, said TE cathode configured to emit a low-power surrogate electron beam coaxially with the primary electron beam, wherein surrogate electron beam has a diameter less than or equal to 1/10th of the diameter of the primary electron beam and an average power less than 1/1,000th the peak power of the primary electron beam;

(b) positioning a fluorescent target between the FE cathode and the cylindrical RF generating tube, drawing a vacuum on the source, activating the TE cathode to emit the surrogate electron beam to strike the fluorescent target causing it to fluoresce in a spot, visualizing the spot through the cylindrical RF generating tube to measure the position of the surrogate electron beam and adjusting at least translational positions of the primary cathode or cylindrical RF generating tube to center the spot on the fluorescent target;

(c) breaking vacuum and removing the fluorescent target;

(d) positioning the fluorescent target aft of the cylindrical RF generating tube, drawing a vacuum on the source, activating the TE cathode to emit the surrogate electron beam to strike the fluorescent target causing it to fluoresce in a spot, visualizing the spot to measure the position of the surrogate electron beam and adjusting at least an angular position of the magnet to center the spot on the fluorescent target; and repeating steps (b)-(d) until measured position of the surrogate electron beam satisfies a coaxial alignment tolerance.

* * * * *